US006613970B2

(12) United States Patent
Davies

(10) Patent No.: US 6,613,970 B2
(45) Date of Patent: Sep. 2, 2003

(54) PROCESS OF MAKING ACOUSTIC DEVICES

(76) Inventor: Maurice P. Davies, 57 Orchard Way, London Road, Ashford Middlesex TW15 3AU (GB)

( * ) Notice: Subject to any disclaimer, the term of this patent is extended or adjusted under 35 U.S.C. 154(b) by 0 days.

(21) Appl. No.: 09/921,120

(22) Filed: Aug. 2, 2001

(65) Prior Publication Data

US 2003/0024374 A1 Feb. 6, 2003

(51) Int. Cl.[7] ..... G10D 13/08
(52) U.S. Cl. ..... 84/402
(58) Field of Search ..... 84/402, 403, 404, 84/406, 408, 409, 410

(56) References Cited

U.S. PATENT DOCUMENTS 5,177,310 A * 1/1993 Davies ..... 84/404
D339,602 S 9/1993 Davies
6,027,324 A * 2/2000 Hull ..... 264/401

* cited by examiner

*Primary Examiner*—Kimberly Lockett
(74) *Attorney, Agent, or Firm*—Arthur F. Zobal; Geoffrey A. Mantooth

(57) ABSTRACT

A method of using a computer controlled machine to provide a hand plate for a predetermined pitch acoustic musical instrument device utilises the accuracy, repeatability and computer facility to use the scaling factor of the operating program of a forming machine controlled by a programmed computer. As shown in FIG. 1 an acoustic musical hand plate instrument comprises a plate 1, a handle 2, and a clapper mechanism 3. The plate 1 is made from a sheet of aluminum alloy. The parameters of the plate 1 and its operation as a musical instrument is substantially as described in U.S. Pat. No. 5,177,310. The handle 2 is a bifurcated block of plastics material into which the plate 1 is secured by means of two recessed bolts 4. The clapper mechanism 3 is mounted on the handle 2 by means of a pivot block 5 containing screw means 17 for adjusting the rotational friction of the clapper mechanism 3. Alternatively, the clapper may be coupled to the handle by means of an elastomeric material as described in U.S. Pat. No. 5,177,310. The clapper shaft 6 is formed from a metal rod, and a clapper head 7 may be of multi-layered construction.

19 Claims, 2 Drawing Sheets

PROCESS OF MAKING ACOUSTIC DEVICES

The invention relates to making an acoustic device. More particularly, the invention relates to flat plate musical instruments of the type invented in 1989 by Maurice P. Davies, now sold under the trade mark Belleplates. Such instruments and their operation are described in U.S. Pat. No. 5,177,310. This type of musical instrument is known generically as a hand plate.

The term hand plate was coined by Guy Ratcliffe in his book The Handbell Handbook, published by Mayola Music (ISBN 0-946477-02-7). As used in this specification the term hand plate defines the range of musical instruments now known by the expression.

BACKGROUND TO THE INVENTION

Hand-held musical bells were known in China over 5,000 years ago. The development of handbells has been slow. It was not until the 16th century that handbells were introduced into England. Since then their popularity has grown and they are now universally rung by groups of handbell ringers.

Handbell ringers now have a choice of three types of musical instruments. The traditional bell form of handbell becomes excessively heavy when the range of notes is extended into lower octaves. This problem has been overcome in part by casting such bells from an aluminum alloy instead of the more traditional alloy of tin and copper.

Hand bells are often rung with more than one bell in each hand. This is facilitated by the open loop handles. However, the loop handle becomes impracticable as the size of the bell becomes too cumbersome or heavy to permit more than one instrument to be held in each hand.

Bell ringers also use a recently developed form of handbell known as hand chimes. These chimes consist of a tube, one end of which is bifurcated and struck externally by a clapper to cause the column of air to resonate between the bifurcated mouth of the tube and, either an optional stop plate within the tube, or, the other open end of the tube. These instruments also suffer from size and weight problems in the lower registers. The tubes become less manageable the lower the note, and such chimes have to be supported on rests whilst the clapper is caused to strike the tube.

PRIOR ART

The Belleplates described in U.S. Pat. No. 5,177,310 overcome the manageable weight and size problems of traditional bells and hand chimes. This is achieved using a light aluminum alloy, and particularly because the size of the plate between any given note and the corresponding lower octave note increases proportionally to the reciprocal of root two, that is to say, the lower note hand plate is only 1.414 times the size of the plate one octave up. As the size of hand plates increases the traditional loop handles may be replaced by a solid handle that is more durable and easily grasped for playing.

Hand plates may be played with a full five octaves (61 bells) or more. The flat shape of hand plates produces a further advantage as they may be stored and carried in a smaller space than the traditional hand bells or hand chimes.

However, hand plates need to be accurately formed to a predetermined size to produce the desired note or they have to be subsequently modified and tuned. It has been found that the structure of the clapper mechanism used on known instruments has some drawbacks and may be modified to improve the sound produced, especially when the instrument is played in the so-called plucking mode. There is a significant cost saving in the production process if the hand plates require little or no fine tuning once they have been cut to size. It has been found that the program used to operate milling machines contains a scaling facility that enables a range of hand plates to be produced using a variety of materials.

NOVEL ASPECTS OF THE PRESENT INVENTION

The present invention permits hand plates to be very accurately and reproducibly formed from a relatively light aluminum alloy that may be anodised or otherwise surface treated with a protective surface material.

If perfect pitch is required the hand plates may be finely tuned by the addition or removal of metal during the construction process to produce a full range of accurately tuned notes.

Hand plates produced according to the invention may be constructed with a clapper mechanism having a multi-layered striker ball or cylindrical clapper head and an adjustable bob weight on the clapper rod to achieve a variable weight effect. The offset distance between the plate and the clapper ball of the clapper mechanism may also be varied, preferably by a resilient elastomeric material that assists in the return of the clapper to its standing position. The pivot arrangement of the clapper mechanism may be modified to provide an adjustable resistance to movement.

STATEMENT OF INVENTION

According to the present invention there is provided a method for producing a predetermined pitch acoustic musical instrument device in the form of a hand plate comprising forming the desired shape of the hand plate from a metal sheet of known thickness and material composition by using a forming machine controlled by a programmed computer.

Preferably the forming machine is a computerised numerically controlled (CNC) milling machine, router, or a laser cutter. The computer program enables substantially identical plates to be reproduced within prescribed tolerances to provide instruments with the desired frequency and sustain characteristics. The computer program may include a spreadsheet of data required to produce the range of parameters for the desired range of instruments.

The sheet metal material of the hand plate is preferably an aluminum alloy generally selected from 2 to 5 millimeters (mm) material. The sheets may be surface treated by mechanical abrasion, such as by wire brushing, or by chemical or electrolytic etching. The surface treatment of the plates may be used to fine tune the hand plates by adding or removing material. Alternatively, the mass of the plate of a hand plate may be modified by welding on additional metal or by removing metal by milling, drilling, or the like. The thickness of sheet metal used to produce the plates may be selected to provide the desired pitch and sustain characteristics, often referred to as frequency or tone, and resonance or persistence of each note.

Hand plates produced by the above method may include a clapper mechanism consisting of a pivot means, a clapper head and a rod rigidly connecting the head to the pivot means, wherein the pivot means includes friction means for adjusting the rotational friction of a pivot axle. The friction means may be one or more screw means acting on one or both ends of the pivot axle. The adjustment provided by screw means is set to achieve the desired response for an individual ringer. The pivot axle may be rigidly connected to the rod by means of a connecting block of rigid material, such as brass or plastics. The pivot axle passes through the connecting block and may be secured to it by glue or a transverse grub screw engaging with the longitudinal side of the axle, or by an interference fit.

The clapper head may consist of a core of brass or similar hard metal material securely mounted on the end of the rod, and covered with a ball of elastomeric material that is coated with a soft felt material. The density of the soft felt material may be varied around the striking circumference of the clapper head so that, by rotation of the head on the rod a desired strike effect may be produced on the plate. A layer of woven material may replace the felt, or may be provided as an additional layer of material surrounding elastomeric ball. The ball may be spherical, cylindrical or other suitable shape for striking the plate.

An additional bob weight may be demountably mounted on the rod. The weight of the bob and the distance of the bob weight from the clapper head may also be selected and set to provide a desired effective mass of the clapper head to suit individual ringers.

At the pivot axle end of the rod a profiled and adjustable resilient cam means may be provided to bear on the plate at its acoustic node. The cam may be rotated to increase or decrease the distance of the clapper head from the plate in a standing condition. The resilience of the material of the cam may be selected to obtain the desired reaction to movement of the clapper mechanism.

In the preferred form, the method according to the present invention is applied to the production of acoustic devices as described and claimed in U.S. Pat. No. 5,177,310 (U.K. Patent 2,238,420) and as shown in U.S. Reg. Des. 339,602 (U.K. Registered Design 2,009,983).

The aluminum sheet metal for the plate may be produced by a rolling, extrusion, protrusion or pultrusion process permitting dies to produce the desired parameters of the material suitable for forming to the desired dimensions of musical instruments.

DESCRIPTION OF THE DRAWINGS

The invention will now be described, by way of example, with reference to the accompanying drawings in which.

SPECIFIC DESCRIPTION

Figure 1:
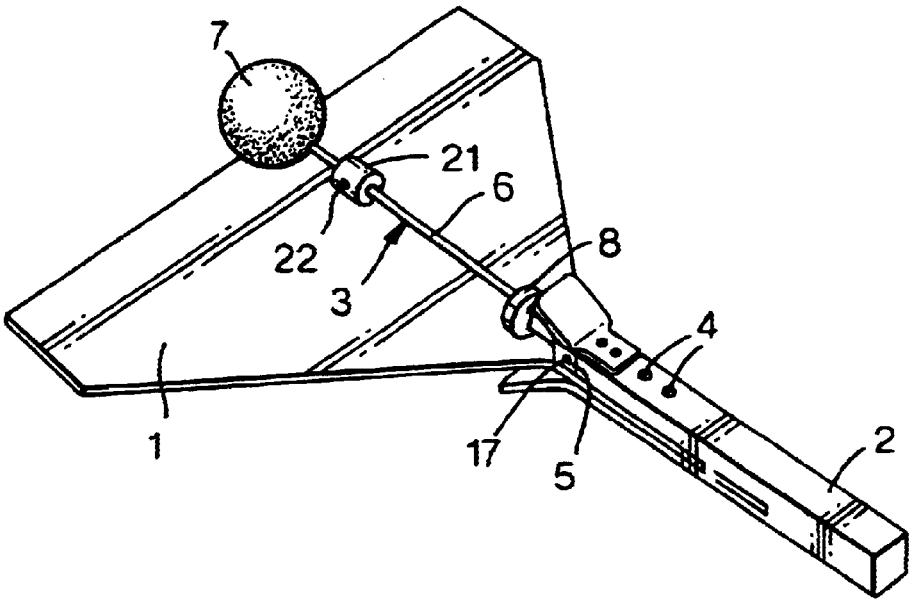
FIG. 1 shows a hand plate acoustic device.

Referring now to the drawing, FIG. 1 shows a hand plate comprising a plate 1, a handle 2, and a clapper mechanism 3. The plate 1 is made from a sheet of aluminum alloy, between 2 to 5 millimeters (mm) thick, by a method to be described below. The shape of the plate 1 and its operation as a musical instrument is substantially as described in U.S. Pat. No. 5,177,310 (U.K. Patent 2,238420). The handle 2 is a bifurcated block of plastics material into which the plate 1 is secured by means of two recessed bolts 4. The clapper mechanism 3 is mounted on the handle 2 by means of a pivot block 5 which is shown in more detail in FIG. 3. The clapper mechanism 3 consists of the pivot block 5, a clapper shaft 6 formed from a metal rod, and a clapper head 7. The head 7 is shown in the form of a spherical ball, however the head may be a cylindrical disc of elastomeric material such as rubber or Neoprene. An eccentric ring or cam 8 is mounted at the pivot block end of the shaft 6 so that it bears on the plate 1 at a nodal point. A guard flange 9 projects from the handle 2 so that when it is placed on a flat surface the handle is lifted from the surface enabling it to be readily grasped in a suitable position for ringing.

Ringers prefer to tailor the ringing characteristics of their instrument to suit their personal requirements. The hand plate shown in FIG. 1 has a number of personalizing adjustments, one of which is illustrated and will now be described with reference to FIGS. 2*a*–2*e*.

Figure 2A:
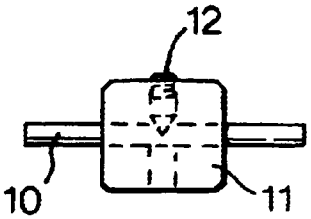
FIG. 2*a* shows a plan view of a pivot axle mounted in a block of plastic material.
Figure 2B:
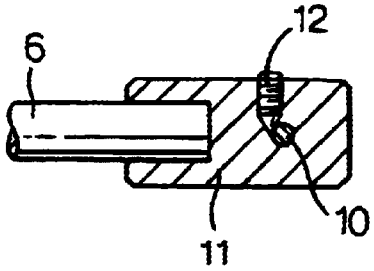
FIG. 2*b* is a cross-section elevation view of FIG. 2*a* showing how the grub bears against the axle.

FIG. 2*a* shows a plan view of a pivot axle 10 mounted in a block 11 of plastics material, such as brass or Nylon. The axle 10 is held against rotation in the block 11 by means of a grub screw 12. Alternatively, the axle 10 may be a tight force fit or glued against rotation in the block 11. FIG. 2*b* is a cross sectional elevation view of FIG. 2*a* showing how the grub screw 12 bears against the axle 10.

Figure 2C:
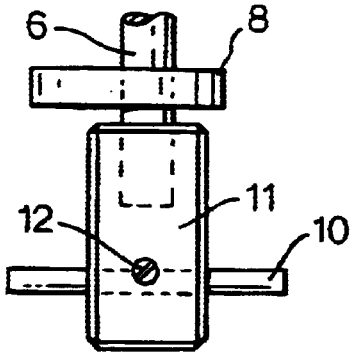
FIG. 2*c* shows the mounting of the shaft in the block.

FIG. 2*c* shows the mounting of the shaft 6 in the block 11. The eccentric cam 8 of elastomeric material is mounted on the shaft 6 close to the block 10.

Figure 2D:
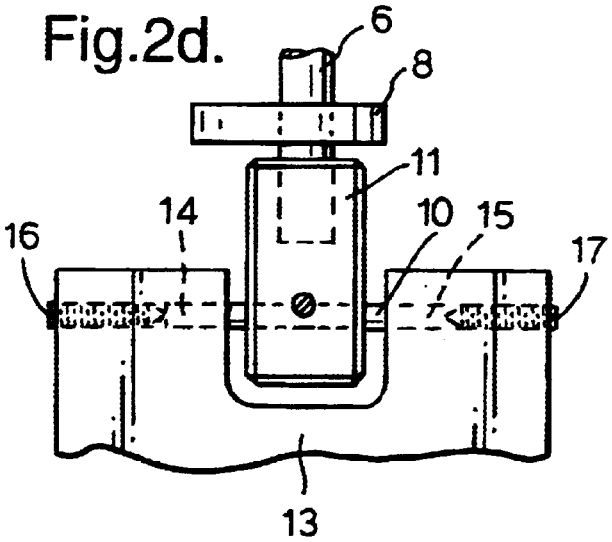
FIG. 2*d* shows the mounting arrangement for the axle in a housing held in place on the handle.

FIG. 2*d* shows the mounting arrangement for the axle 10 in a housing 13 held in place on the handle 2 (not shown in FIGS. 2*a*–2*e*). Ends 14 and 15 of the axle 10 are cylindrical so that they may rotate within cylindrical bearing surfaces in the housing 13. Grub screws 16 and 17 set into the sides of the housing 13 so as to bear against the shaped conical shaped ends of the axle 10.

Figure 2E:
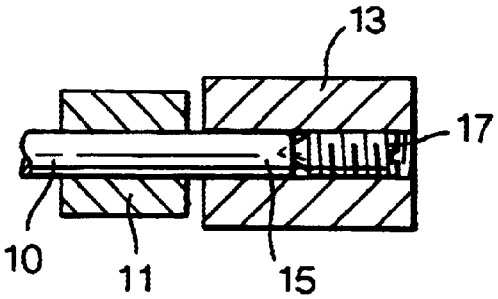
FIG. 2*e* shows the axle held in the block and mounted in a bearing surface in the housing.

This action is illustrated more particularly in FIG. 2*e* which shows the axle 10 held in the block 11 and mounted in a bearing surface in the housing 13. It will be seen how the grub screw 17 engages with the shaped end 18 of the axle 10. By adjusting the axial force exerted by the grub screws 16 and 17 on the axle 10 the rotational freedom of movement of the axle may be adjusted. If required one end of the axle 10 may be mounted in a blind hole in the housing 13 so that a single grub screw may provide the necessary force to damp the rotation of the pivot axle 10.

Figure 3:
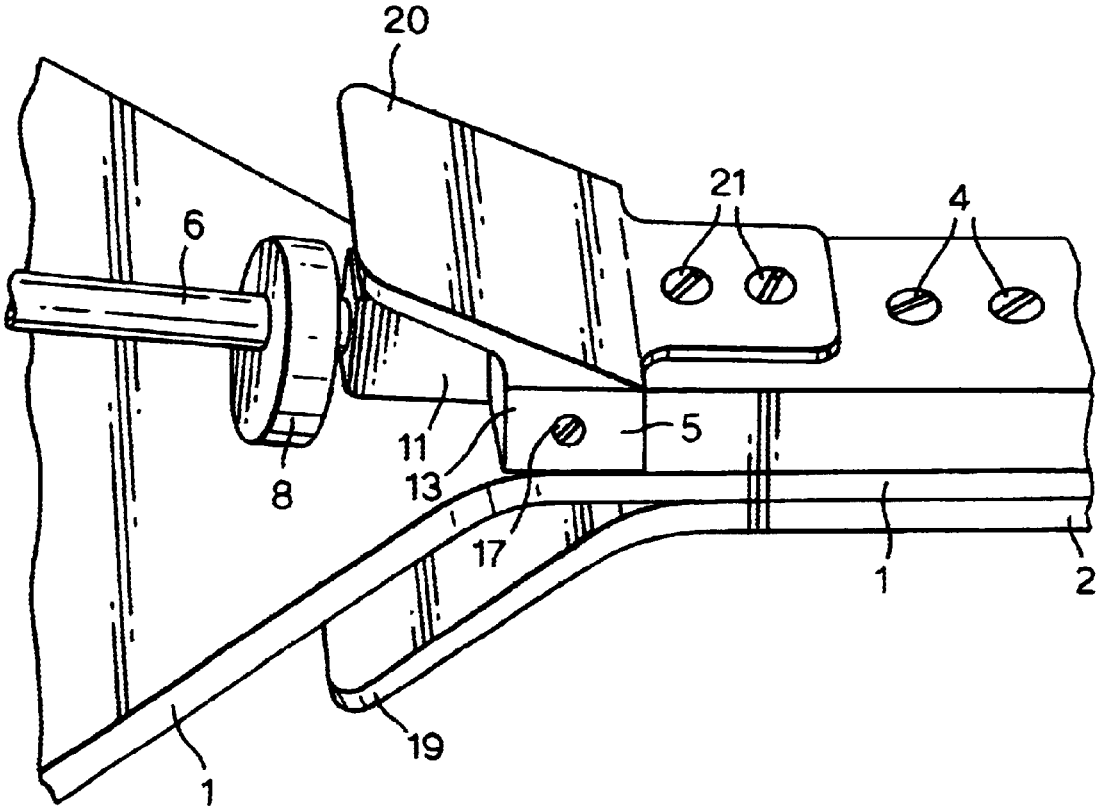
FIG. 3 shows frictional adjustment means for the pivot block of FIGS. 2*a*–2*e*.

FIG. 3 shows the assembled pivot mechanism on the hand plate handle. Initially, the plate 1 is placed in the bifurcated end of the handle 2 and secured by screws 4. One side of the bifurcated end of the handle 2 forms the housing 13. The other side of the bifurcated end of the handle 13 is formed with a flange 19 for lifting the handle 2 a convenient distance from a flat surface on which the hand plate is laid.

The pivot block 5 is assembled by passing the axle 10 through one side bearing in the housing 13, through the pivot block 11, and into the bearing surface on the other side of the housing 13. The axle 10 is firmly secured to the pivot block 11 by the grub screw 12, and the rotation adjusting grub screws 16 and 17 are screwed into the open ends of the bearing holes in the housing 13 and tightened as required to control the freedom of rotation of the axle 10.

The specific note for each hand plate may be inscribed or otherwise applied to a plate 20 mounted by means of screws 21 on the upper surface of the handle 2. Alternatively, the bifurcated end of the housing 13 may be extended to form the plate 20.

The clapper head 7 as shown in FIG. 1 consists of a spherical or cylindrical brass core secured to the end of the shaft 6. The core is sheathed with an elastomeric material which is covered by layer of cloth and/or felt material. The composition of the various layers of material may be selected to produce the desired attack characteristics for the clapper mechanism. Alternatively, the circumferential composition of one or more of the materials may be varied so that a ringer may rotate the head 7 on the shaft 6 to produce a desired effect. For hand plates producing the higher notes, the core weight may be reduced or even omitted.

The shape of the plate 1 is not limited to that shown but may be square or any other shape within those described and claimed in U.S. Pat. No. 5,177,310 (U.K. Patent 2,238,420).

In the method according to the present invention the aluminum sheet is profiled to the desired shape by means of a CNC milling machine, or router or a computer controlled laser shaping machine. The program accurately reproduces substantially identical plates each having the desired pitch and it can be scaled to create a predetermined range of plates to form at least a five octave range of Belleplate hand plates. Operators of CNC machines, and the like, are skilled at transferring given data from a spreadsheet into machine readable instructions. It is also known to scan into a CNC machine a given shape outline using known scanning techniques.

The profile plate may be subjected to a surface treatment by mechanical, chemical or electrolytic means. This treatment may be used to finely tune the plate to the desired note. The surface may be protected by an applied material, such as paint, or left in the surface treated state. The anodising treatment may produce a coloured surface as is well known in the art. By wire brushing the surface an attractive grained effect may be produced.

If significant tuning is required, the plate may be milled, drilled or heavily abraded to remove significant mass. Alternatively, mass may be added by using a welding material such as that known as Lumiweld (trade mark).

Figure 4:
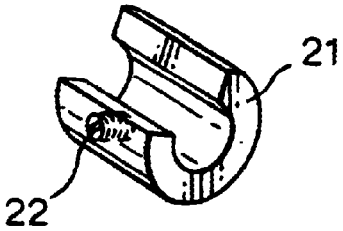
FIG. 4 shows a form of adjustable bob weight.

Referring to FIG. 4 which shows a bob weight 21 consisting of a horseshoe shaped block of metal that clips onto the clapper shaft 6 and can be held in position be one or more screws 22.

Hand bells can produce sounds in a number of ways, one such method includes resting the handbell on a foam covered flat surface and striking the bell metal with either a mallet or by using the clapper internal to the handbell.

It has been found that in use the performance of the hand plate, particularly the lower notes, may be improved in the plucking mode of ringing if the broad edge of the plate is supported at its two nodal points for its fundamental frequency so as to lift the plate from the supporting surface without inhibiting the natural resonance of the device.

It will be appreciated that if necessary other known mechanical equivalents may replace the components described with reference to the drawings.

What is claimed is:

1. A method for producing a predetermined pitch acoustic musical instrument device within prescribed tolerances and having predetermined frequency and sustain characteristics, and within prescibed tolerances to avoid said need for hand-finishing, and comprising a metal plate having a first location and a configuration expanding outwardly from said first location in a direction on opposite sides of a first axis extending through said first location, said configuration providing two diverging rectilinear edges of substantially equal length, each said length being a first dimension, and two substantially parallel rectilinear edges of substantially equal length remote from said first location, said substantially parallel edges being spaced from one another at a distance, being a second dimension, along a second axis at right angles to said first axis and crossing said first axis at a second location spaced a distance, being a third dimension, from said first location wherein said first and third dimensions are within a ratio of 0.75:1 and 1.25:1 and said first and second dimensions are within a ratio of 0.75:1 and 2.5:1 such that, when said plate is supported at least as far from said second location as said first location and is subjected to a stimulus, said plate resonates, said device including a clapper mechanism consisting of a pivot means, a clapper head and a rod rigidly connecting said head to said pivot means, and said method including a computer program controlled milling machine having a program including a scaling factor derived for each given thickness of metal sheet and derived for each composition of sheet material, and arranged to produce said desired shape of said hand plate from said metal sheet of known thickness and material composition according to dimensions derived from a spreadsheet of data to produce a range of parameters of musical instruments; comprising the steps of:

forming said hand plate of said given shape from said metal sheet of known thickness and material composition by cutting said metal sheet to form said metal plate to said given shape with said forming machine, during the forming process, controlling said forming machine with a programmed computer, the data to control said forming machine being derived within a computerized spreadsheet such that subsequent further hand plates of the same note may be produced from similar sheets also of known thickness and material composition and said spreadsheet also allowing for variations in the thickness of the metal sheet to be accommodated.

2. A method for producing a predetermined pitch acoustic musical instrument device as claimed in claim 1 in which a pivot axle is rigidly connected to said rod by means of a connecting block of rigid material, and wherein said pivot means is provided with friction means acting on said pivot means for adjusting said rotational friction of said pivot axle.

3. A method for producing a predetermined pitch acoustic musical instrument device as claimed in claim 2 in which said friction means is screw means acting on at least one end of said pivot axle.

4. A method for producing a predetermined pitch acoustic musical instrument device as claimed in claim 3 in which said pivot axle passes through said connecting block and is secured thereto by a transverse grub screw engaging with a longitudinal side of said axle.

5. A method of producing a predetermined pitch acoustic musical instrument device in the form of a hand plate as claimed in claim 1 in which said spreadsheet is produced to permit a scalar range of substantially identically designed profiles to be produced so that a series of plates are thereby generated with different acoustic notes in a acoutic scale.

6. A method as claimed in claim 5 in which said plate is an aluminum material between 2 mm to 5 mm thick which is machine finished by surface treatment to fine tune the note produced by said plate.

7. A method for producing a predetermined pitch acoustic musical instrument device as claimed in claim 1 in which said clapper head comprises of a metallic core securely mounted on the end of said clapper rod, and covered with a ball of elastomeric material that is coated with a soft material.

8. A method for producing a predetermined pitch acoustic musical instrument device as claimed in claim 7 in which the density of said soft material is varied around the striking circumference of said clapper head so that, by rotation of said head on said clapper rod a desired strike effect is produced on said plate.

9. A method as claimed in claim 1 for producing a predetermined pitch acoustic musical instrument device in which a bob weight is demountably mounted on said rod.

10. A method as claimed in claim 9 for producing a predetermined pitch acoustic musical instrument device in which said weight of said bob and the distance of said bob weight from said clapper head is selected and set to provide a desired effective mass of said clapper head to suit individual ringers.

11. A method as claimed in claim 1 in which a profiled cam is provided at said pivot axle end of said clapper rod and profiled to bear on said plate at an acoustic node.

12. A method as claimed in claim 11 in which said cam may be rotated to vary said distance of said clapper head from said plate in a standing condition.

13. A method as claimed in claim 11 in which said resilience of said material of said cam is selected to obtain said desired reaction to movement of said clapper mechanism.

14. A method as claimed in claim 1 in which a predetermined pitch acoustic musical instrument device having a multi-layer clapper head is produced.

15. A method as claimed in claim 14 in which a predetermined pitch acoustic musical instrument device having a multi-layer spherical clapper head is produced.

16. A method as claimed in claim 14 in which a predetermined pitch acoustic musical instrument device having a multi-layer cylindrical clapper head is produced.

17. A method for producing a predetermined pitch acoustic musical instrument device in the form of a metal hand plate of a given shape having a first location and configuration expanding outwardly from said first location in a direction on opposite sides of a first axis extending though said first location, said configuration providing two diverging rectilinear edges of substantially equal length, each said length being a first dimension, and two substantially parallel rectilinear edges of substantially equal length remote from said first location, said substantially parallel edges being spaced one from another at a distance, being a second dimension, along a second axis at right angles to said first axis and crossing said first axis at a second location spaced a distance, being a third dimension, from said first location wherein said first and third dimensions are within a ratio of 0.075:1 and 1.25:1 and said first and second dimensions are within a ratio of 0.75:1 and 2.5:1 such that, when said plate is supported at least as far from the second location and said first location and is subjected to a stimulus, said plate resonates, comprising the steps of:

forming said hand plate of said given shape from a metal sheet of known thickness and material composition by cutting said metal sheet to form said metal plate to said given shape with a forming machine, during the forming process, controlling said forming machine with a programmed computer, the data to control said forming machine being derived within a computerized spreadsheet such that subsequent further hand plates of the same note may be produced from similar sheets also of known thickness and material composition and said spreadsheet also allowing for variations in the thickness of the metal sheet to be accommodated.

18. A method for producing a predetermined pitch acoustic musical instrument device in the form of a metal hand plate of a given shape having a first location and configuration expanding outwardly from said first location in a direction on opposite sides of a first axis extending though said first location, said configuration providing two diverging rectilinear edges of substantially equal length, each said length being a first dimension, and two substantially parallel rectilinear edges of substantially equal length remote from said first location, said substantially parallel edges being spaced from one another at a distance, being a second dimension, along a second axis at right angles to said first axis and crossing said first axis at a second location spaced a distance, being a third dimension, from said first location wherein said first and third dimensions are within a ratio of 0.075:1 and 1.25:1 and said first and second dimensions are within a ratio of 0.75:1 and 2.5:1 such that, when said plate is supported at least as far from the second location as said first location and is subjected to a stimulus, said plate resonates, comprising the steps of:

forming said hand plate of said given shape from a metal sheet of known thickness and material composition by cutting said metal sheet to form said metal plate to said given shape with a forming machine, during the forming process, controlling said forming machine with a programmed computer, the data to control said forming machine being derived within a computerized spreadsheet such that subsequent further hand plates of other notes may be produced from similar sheets also of known thickness and material composition and said spreadsheet also allowing for variations in the thickness of the metal sheet to be accommodated.

19. A method for producing a predetermined pitch acoustic musical instrument device in the form of a metal hand plate of a given shape having a first location and a configuration expanding outwardly from the first location in a direction on opposite sides of a first axis extending through the first location, the configuration providing two diverging rectilinear edges of substantially equal length, each said length being a first dimension, and two substantially parallel rectilinear edges of substantially equal length remote from the first location, said substantially parallel edges being spaced one from another at a distance, being a second dimension, along a second axis at right angles to the first axis and crossing the first axis at a second location a distance, being a third dimension, from the first location wherein the first and third dimensions are within a ratio of 0.75:1 and 1.25:1 and the first and second dimensions are within a ratio of 0.75:1 and 2.5:1 such that, when said plate is supported at least as far from the second location as the first location and is subjected to a percussive stimulus, the plate resonates, comprising the steps of:

forming, from a uniform sheet of material of given thickness and given composition, a metal hand plate of given shape;

measuring the said dimensions of the hand plate;

supporting the plate at least as far from the said second location as said first location;

measuring and recording the audio frequency generated by the hand plate while subjected to a percussive stimulus;

compiling computer input data for a spreadsheet from the said dimensions, said given thickness, said given composition, said recorded frequency, and said given shape;

inputting said input data to a computer arranged to control a metal forming machine;

selecting one of a range of desired frequencies to be generated by a machine formed hand plate, and inputting said selected frequency into said computer as the control parameter so that the said forming machine forms a hand plate having said selected desired frequency when subjected to a percussive stimulus; and, wherein the said spreadsheet and computer program are arranged to control said forming machine to form hand plates of any desired frequency in said range, allowing for variations in the thickness of the metal sheet to be accommodated.

* * * * *